United States Patent [19]

Zweig

[11] Patent Number: 4,890,655

[45] Date of Patent: Jan. 2, 1990

[54] BUTT-END WOOD HOLDING SYSTEM

[75] Inventor: Siegfried Zweig, Oberkochen, Fed. Rep. of Germany

[73] Assignee: Okoma Oberkochener Machinen GmbH, Oberkochen, Fed. Rep. of Germany

[21] Appl. No.: 342,623

[22] Filed: Apr. 18, 1989

Related U.S. Application Data

[63] Continuation of Ser. No. 197,135, May 13, 1988, abandoned.

[30] Foreign Application Priority Data

May 23, 1987 [DE] Fed. Rep. of Germany ..... 3717412

[51] Int. Cl.[4] ..... B27F 5/00

[52] U.S. Cl. ..... 144/82; 144/2 R; 144/198 R; 144/203; 269/56; 269/58; 269/61

[58] Field of Search ..... 269/56, 58, 61; 144/136 R, 2 R, 203, 204, 198 R, 82, 83

[56] References Cited

U.S. PATENT DOCUMENTS 1,956,748 5/1934 Schroff ..... 144/203

4,478,264 10/1984 Miller et al. ..... 144/82

*Primary Examiner*—W. Donald Bray

*Attorney, Agent, or Firm*—Wells & White

[57] ABSTRACT

A butt-end wood holding system for a tenoning-and-mortising apparatus. The butt-end wood holding system comprising a pivotal guide member which engages the butt-end of a work-piece. The pivotal guide member is rotatably linked to the relatively fixed base of the mortising-and-tenoning spindle so that rotation of a concentric and rotatable support ring of the guide member, located about the spindle support, results in a parallel horizontal translation of the pivoting guide member. The butt-end wood guide member support being separately linked to the relatively fixed mortising-and-tenoning spindle support.

8 Claims, 2 Drawing Sheets

BUTT-END WOOD HOLDING SYSTEM

This application is a continuation of application Ser. No. 197,135 filed May 13, 1988, abandoned.

BACKGROUND OF THE INVENTION

The invention concerns a butt-end wood holding system for woodworking machines including tenoning-and-mortise cutting spindle(s) and comprising at least one butt-end wood holder which can be horizontally pivoted into position against the butt-end of a window wood, this butt-end wood holder being mounted on a horizontally displaceable support.

In known apparatus of this kind, the butt-end wood holder is mounted on mutually parallel guide means so that the axial directions of the butt-end wood holders remain unchanged during the horizontal pivoting motion.

This known apparatus incurs the drawback that the guide support for the holder is fixed to the machine frame, whereby the tenoning-and-mortising spindle can be moved only vertically. The fixed assembly of the holder prevents laterally displacing the spindle.

SUMMARY OF THE INVENTION

Accordingly, it is the object of the invention to so design a butt-end wood holder system of the kind wherein the tenoning-and-mortising spindle can be moved transversely to its shaft.

This problem is solved by the present invention by mounting in a rotatable manner a ring concentric with the tenoning-and-mortising spindle and joined to the spindle's fixed support. A rotatable disk supporting a butt-end wood holder is mounted to the periphery of that ring, this disk being connected by a flexible, locking link such as a toothed belt or a chain or the like to a further disk of equal size fixed concentrically to the spindle.

This design makes it possible to keep the butt-end wood holder connected to the spindle or the spindle's bearing, whereby, upon a lateral displacement of the spindle, the butt-end wood holder system follows the motion of the spindle. Thereby the spindle can be moved laterally at will.

Because the flexible locking link connects the the butt-end wood holder and the fixed spindle disk, the relative alignment of the holder remains constant when there is a motion of the butt-end wood holder system in a horizontal plane around the spindle axis. Accordingly, a parallel shift of the butt-end wood holder system takes place when this system is moved horizontally out of the area of the workpiece to be processed.

The horizontal pivoting motion, ie, the motion in a horizontal plane, can be carried out in a number of ways. Illustratively, the ring may be equipped with external teeth engaged by a motor-driven pinion. This outer toothing for instance may be in the form of a chain of which the individual links are mounted on the outer circumference of the ring, for instance by means of screws or welding.

Also, instead of the flexible locking link, one employing friction, for instance in the form of a friction wheel also may be used because only the final position, not the pivoting motion itself, is critical.

Further, the ring adjustment also can be implemented manually using a lever, or by means of a hydraulic or pneumatic actuator acting on an arm. Preferably the invention provides two mutually facing butt-end wood holder systems mounted to the ring, and this design is especially significant when—as proposed for another machine—the processing of the two ends of a window wood is performed by different sides CL BRIEF DESCRIPTION OF THE DRAWINGS The invention is more comprehensively discussed below in relation to an illustrative embodiment shown in the drawings.

FIG. 1 is a topview of the butt-end wood holder system of the invention together with a tenoning-and-mortising spindle, FIG. 2 is the partial section II—II of FIG. 1, and FIG. 3 is the partial elevation III—III of FIG. 1.

DESCRIPTION OF THE PREFERRED EMBODIMENTS

Figure 1:
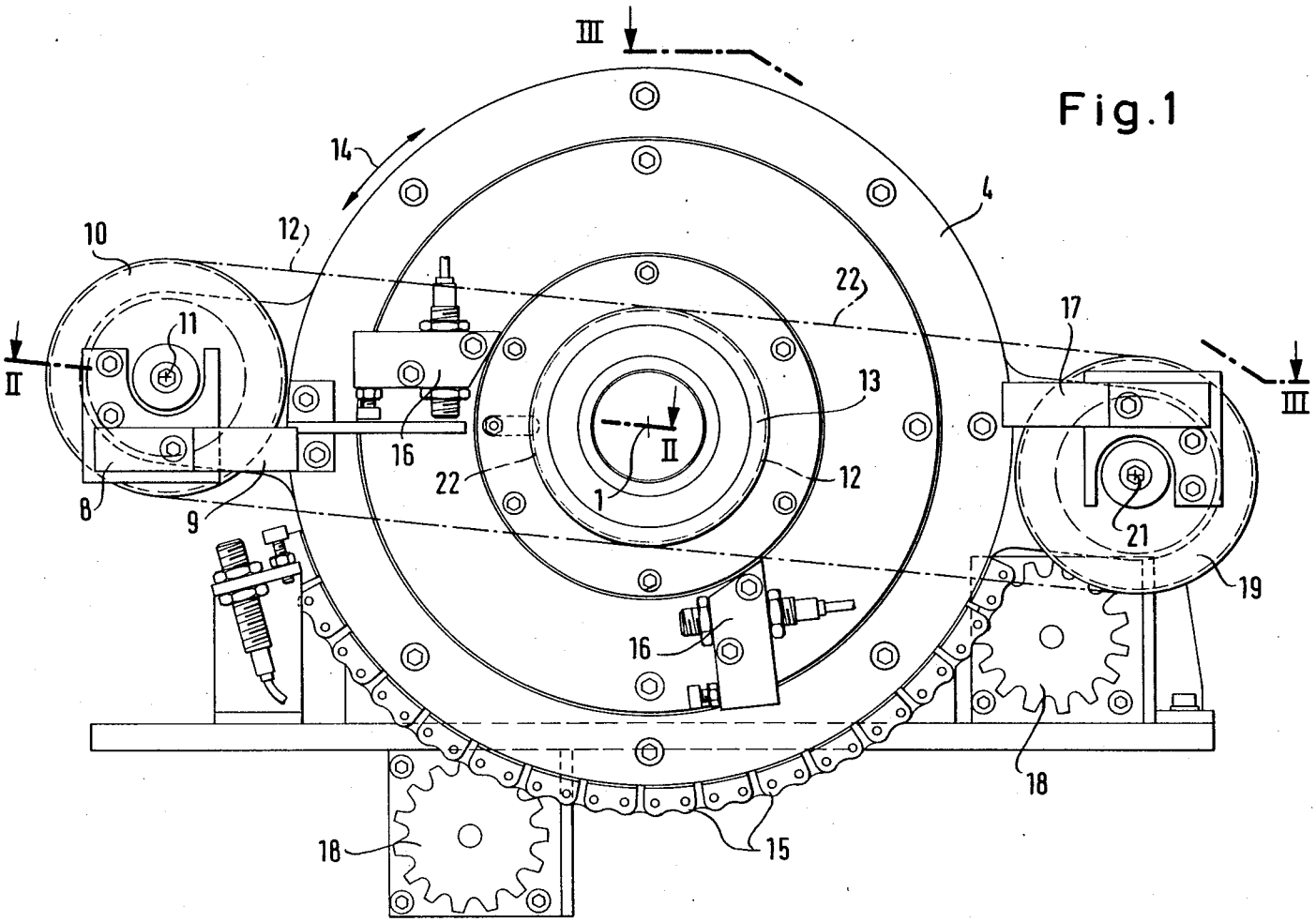
Figure 2:
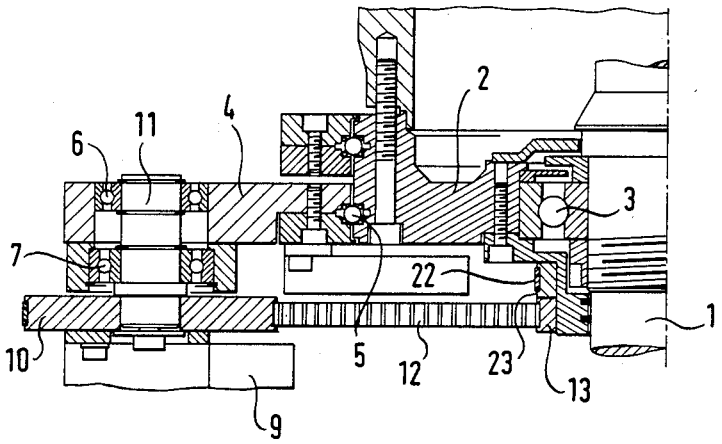
Figure 3:
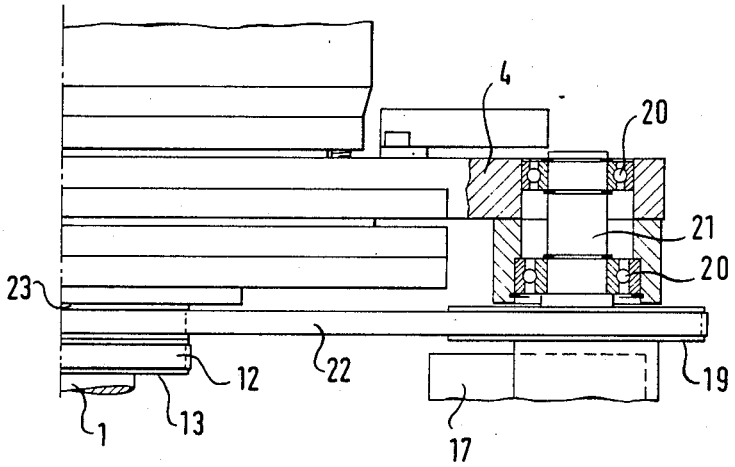

As shown in FIGS. 1 through 3, a tenoning-and-mortising spindle 1 is rotatably supported by roller bearings 3 within a fixed support 2, a ring 4 being rotatably mounted by insertion of bearings 5 on the outer circumference of the support 2 and concentrically with the tenoning-and-mortising spindle 1, whereby this ring 4 can be displaced relative to the support 2.

The bearings 6 and 7 for a rotatable disk 10 supporting the support 8 (FIG. 1) of a butt-end wood holder 9 are mounted to the outer circumference of the ring 4, the disk 10 being seated on a shaft 11 (FIG. 2) and held in bearings 6 and 7.

The rotatable disk 10 bearing members 8 and 9 is connected by a flexible geometrically matching link such as toothed belt, 12 chain or the like, to another disk 13 of equal size. Disk 13 is fixed and concentric with the tenoning-and-mortising spindle 1, flexible link 12 being guided over the disk 13 (FIG. 1).

If the ring 4 is rotated relative to the support 2 in the direction of the double arrow 14 of FIG. 1, then the flexible, locking link 20 remains at rest on disk 13 which is away from the butt-end wood holder system which and the link 12 is wound on or unwound off the disk 13. Thereby the disk 10 moving together with the ring 4, receives a rotary motion whereby, in spite of the rotation of the ring 4, the shafts of the disk and of the butt-end wood holder retain their directions. Accordingly, these components undergo a parallel shift in the horizontal plane.

In the embodiment shown, the ring 4 is equipped with external toothing in the form of a chain 15 of which the individual links illustratively are fastened by screws or by welding to the external circumference of the ring.

Motor-driven pinions 18 may engage this external toothing 15 in order to rotate the ring in the described manner.

However, the ring 4 also may be displaced in other ways, for instance by using a hand lever or hydraulic or pneumatic actuators acting on an arm. The references 16 denote limit switches limiting the range of adjustment of the ring 4.

As shown by FIGS. 1 and 3, it is possible to mount several butt-end wood holding systems to the ring 4. In the embodiment shown, a second butt-end wood holding system 17 is provided opposite the first and is also equipped with a disk 19 rotatably supported in bearings 20, the disk 19 being seated on a shaft 21 and held by the bearings 20 (FIG. 3).

By means of another flexible link 22, the disk 19 is connected to a further fixed disk 23 (FIG. 3) mounted concentrically with the tenoning-and-mortising spindle, whereby, upon rotation of the ring 4, the butt-end wood holder system 17 is also shifted in parallel manner.

Where in the description the support 2 was described as being fixed, this applies only to the parts which are movable relative to this support. All of the tenoning-and-mortising unit may be made displaceable relative to the machine frame.

I claim:

1. In a butt-end wood holding system for woodworking machines having at least one tenoning-and-mortising spindle including a relatively fixed support, and having at least one means for pivoting a butt-end wood holder in a horizontal plane into an operational position against an end of a workpiece, said butt-end wood holder mounted to a horizontally displaceable holder, the improvement comprising:

a ring (4) rotatably mounted on said relatively fixed support of said tenoning-and-mortising spindle (1) and concentrically with said spindle, said ring having an external circumference comprising at least one bearing (6,7) supporting a first rotatably supported disk (10) bearing said butt-end wood holder (9), said first disk (10) connected by a flexible, locking link (12) with a second fixed disk (13) of the same size as said first disk and mounted concentrically with said spindle (1).

2. The butt-end wood holder system of claim 1, wherein said ring further (4) comprises an external toothing (15) engaged by a motor-driven pinion (18).

3. The butt-end wood holder system of claim 2, wherein said external toothing is in the form of a chain of which the individual links are fastened to the external circumference of said ring (4).

4. The butt-end wood holder system of claim 1, wherein a friction-lock is provided between a drive of said ring (4) and its external circumference.

5. The butt-end wood holder system of claim 4, wherein said drive is a friction wheel.

6. The butt-end wood holder system of claim 1, wherein a manual lever is used to displace said ring (4).

7. The butt-end wood holder system of claim 1, wherein two mutually opposite butt-end wood holder systems (8,9,17) are mounted on said ring (4).

8. The butt-end wood holder system of claim 1, wherein two mutually opposite butt-end wood holder systems (8,9,17) are mounted on said ring (4).

* * * * *